US005110285A

United States Patent [19]

Snyder et al.

[11] Patent Number: 5,110,285

[45] Date of Patent: May 5, 1992

[54] FLUIDIC BURNER

[75] Inventors: William J. Snyder, Ossining; John E. Anderson, Somers, both of N.Y.

[73] Assignee: Union Carbide Industrial Gases Technology Corporation, Danbury, Conn.

[21] Appl. No.: 627,834

[22] Filed: Dec. 17, 1990

[51] Int. Cl.[5] ..... F23M 3/02; B05B 1/14

[52] U.S. Cl. ..... 431/8; 431/252; 239/590.5; 239/DIG. 7

[58] Field of Search ..... 431/8, 252, 2, 12; 239/590, 590.5, DIG. 7, 592, 543

[56] References Cited

U.S. PATENT DOCUMENTS

| | | | |
|---|---|---|---|
| 3,876,362 | 4/1975 | Hirose | 431/252 X |
| 4,378,205 | 3/1983 | Anderson | 431/5 |
| 4,431,400 | 2/1984 | Kobayashi et al. | 431/6 |
| 4,488,682 | 12/1984 | Kobayashi et al. | 239/132.3 |
| 4,525,138 | 6/1985 | Snyder et al. | 431/187 |
| 4,541,796 | 9/1985 | Anderson | 431/187 |
| 4,541,798 | 9/1985 | Miller et al. | 431/266 |
| 4,585,177 | 4/1986 | Sugawara et al. | 98/2 X |
| 4,626,195 | 12/1986 | Sato et al. | 431/12 X |
| 4,693,680 | 9/1987 | Snyder et al. | 431/10 |
| 4,738,614 | 4/1988 | Snyder et al. | 431/8 |
| 4,878,829 | 11/1989 | Anderson | 431/8 |
| 4,892,475 | 1/1990 | Farrenkopf et al. | 431/8 |
| 4,907,961 | 3/1990 | Anderson | 431/8 |

OTHER PUBLICATIONS

Fuel Directed Burner, North American Mfg. Co., Cleveland, Ohio, 1985.

*Primary Examiner*—Larry Jones

*Attorney, Agent, or Firm*—Stanley Ktorides

[57] ABSTRACT

Method and apparatus for changing the direction of a fluid stream injected into a combustion zone wherein a flow of biasing fluid is provided to a high velocity fuel or oxidant stream in a perpendicular direction proximate the inlet of an outwardly tapered cavity, causing the fluid stream to be deflected toward a wall of the cavity and to flow in a direction along the wall by a pressure differential across the fluid stream.

17 Claims, 4 Drawing Sheets

FIG. 1
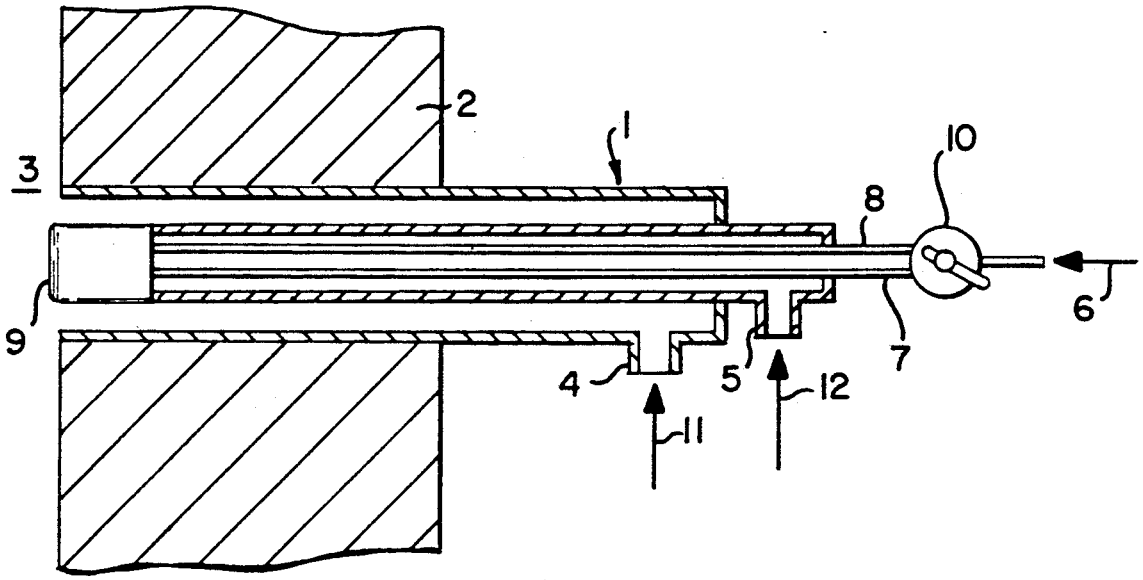
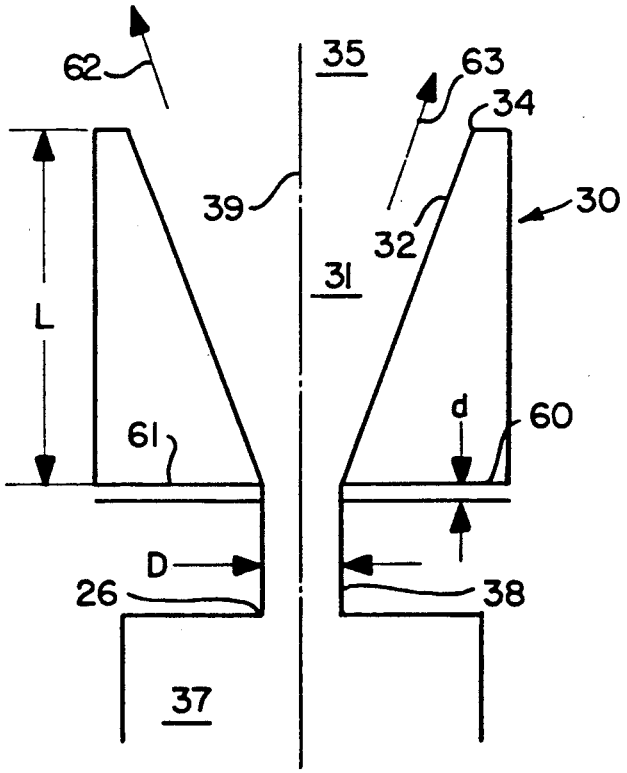
FIG. 3B
FIG. 3A
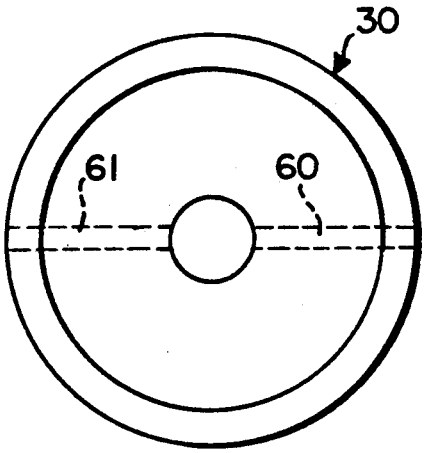

FIG. 2A
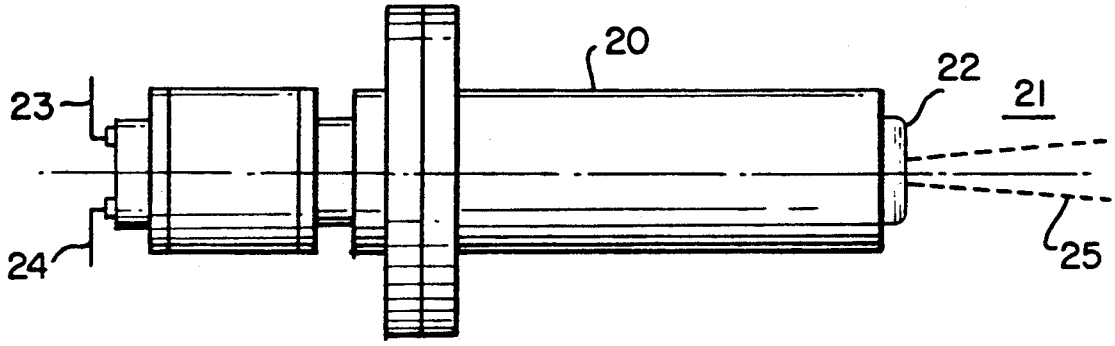
FIG. 2B
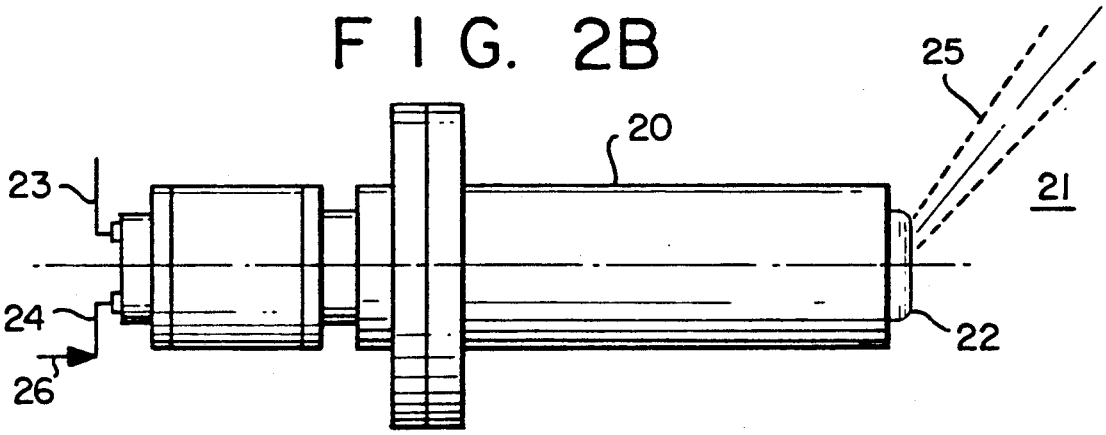
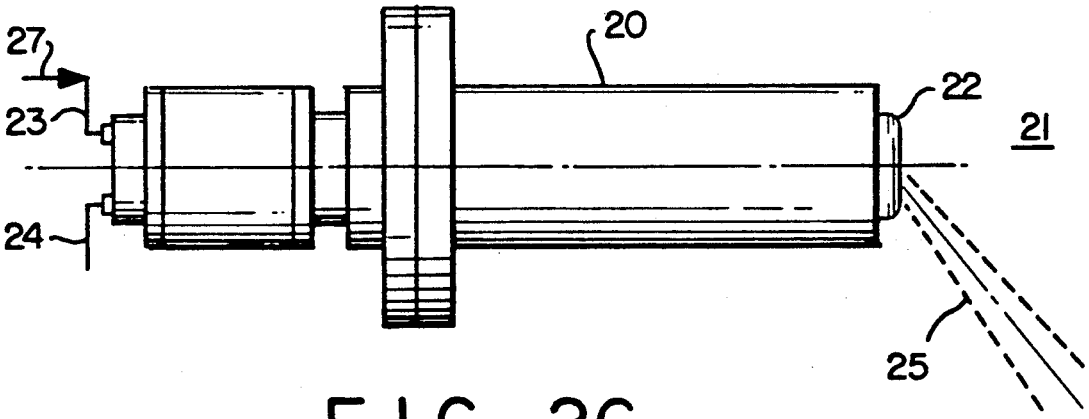
FIG. 2C

FIG. 4A
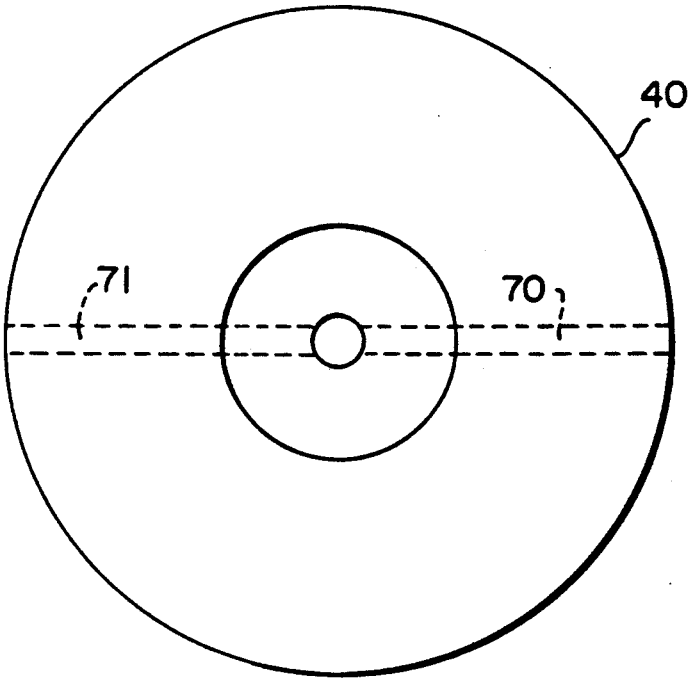
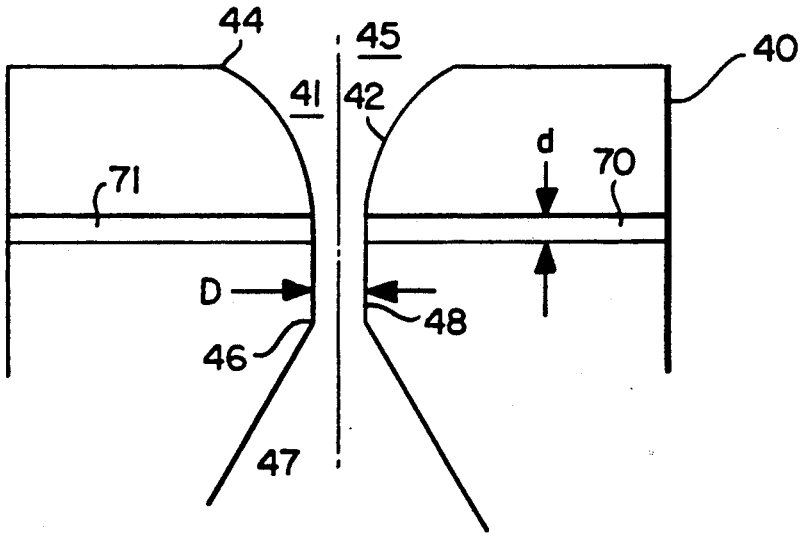
FIG. 4B

FLUIDIC BURNER

TECHNICAL FIELD

This invention relates generally to nozzles for the injection of fluid into a combustion zone and more particularly to burners or lances for injecting oxidant into a combustion zone.

BACKGROUND ART

A conventional burner employed to provide heat to, for example, a furnace is fixed in place in a furnace wall and directs the flame or combustion reaction emanating from the burner to a fixed point in the combustion zone within the furnace. Many burners have controls for changing the shape of the flame from, for example, a long, thin flame to a short, bushy flame in order to better match the heating provided by the burner to the demand required by the furnace charge. However, it is sometimes necessary or desirable to change the direction of the burner flame. For example, in the melting of scrap metal it is desirable to change the direction of the flame to provide heat directly to the unmelted scrap rather than to wait for conduction and convection currents to provide heat to the unmelted scrap from the area within the combustion zone where the flame is directed.

One way of changing the flame direction of a burner is to employ directional nozzles in a burner and change the nozzle when a new flame direction is desired. This method is disadvantageous because it requires that the burner be shut down and cooled every time a flame direction change is required. Moreover this method requires the maintenance of an inventory of directional nozzles.

Another way of changing the flame direction of a burner is to manually adjust the position of the burner either directly or through a mechanical adjusting system. Direct manual adjustment of a burner is dangerous and mechanical adjusting systems are complicated and prone to breakdown in the harsh environment of an industrial furnace. In addition space limitations around an industrial furnace may preclude the deployment of a mechanical adjusting system.

It is desirable therefore to have a system which will easily and effectively enable one to change the flow direction of a fluid passing from a nozzle into a combustion zone, such as an oxidant passing from a burner or lance nozzle into a combustion zone.

When the fluid is high velocity fluid such as a high velocity oxidant which might be employed with an oxygen burner, the desired directional change is much more difficult to effectuate while still maintaining stable operation.

Accordingly it is an object of this invention to provide an apparatus which will enable one to inject high velocity fluid into a combustion zone and to easily change the direction in which the fluid is injected into the combustion zone.

It is another object of this invention to provide a method for easily changing the flow direction of a high velocity fluid being injected into a combustion zone.

SUMMARY OF THE INVENTION

The above and other objects which will become apparent to one skilled in the art upon a reading of this disclosure are attained by the present invention which involves in general the defined application of fluidics to control the flow direction of a high velocity fluid jet passed through a nozzle into a combustion zone. Specifically, one aspect of the invention comprises:

Apparatus for changing the flow direction of a high velocity fluid stream injected into a combustion zone comprising:

(A) a fluidic cavity having a restricted flow area communicating downstream thereof with an expanded flow area, said restricted flow area having a diameter D at said point of communication; and (B) means for providing biasing fluid into the fluidic cavity in a direction substantially perpendicular to the axial centerline of the fluidic cavity, said means having a diameter d such that d/D is within the range of from 0.18 to 0.75, said biasing fluid provision means communicating with the fluidic cavity at a point within the range of from $3d/4$ upstream to d/4 downstream of the point of communication between the restricted flow area and the expanded flow area, where D and d are measured in the same units.

Another aspect of this invention comprises:

Method for changing the flow direction of a high velocity main fluid stream injected into a combustion zone comprising:

(A) providing a flow of main fluid through a fluidic cavity having a restricted flow area communicating downstream thereof with an expanded flow area wherein the main fluid flows through the restricted flow area at a velocity of at least 500 feet per second to establish a reduced pressure zone adjacent a portion of the surface of the fluidic cavity;

(B) injecting a biasing fluid stream having a diameter d into the fluidic cavity at the reduced pressure zone in a direction substantially perpendicular to the flow direction of the main fluid passing through the restricted flow area at a point within the range of from $3d/4$ upstream to d/4 downstream of the point of communication between the restricted flow area and the expanded flow area, where D and d are measured in the same units; and (C) changing the flow direction of the main fluid.

As used herein the term "combustion zone" means the volume into which fluid is passed from the outlet of the fluidic cavity.

As used herein the term "substantially perpendicular" means within plus or minus 15 degrees.

BRIEF DESCRIPTION OF THE DRAWINGS

FIG. 1 is a view partly in cross section of a burner system installed within a furnace which may be employed in conjunction with the invention.

FIG. 2A is an illustration of a burner or lance through which fluid is injected into a combustion zone without a change of direction.

FIG. 2B is an illustration of a burner or lance wherein the flow direction of the fluid is changed by the use of the invention.

FIG. 2C is another illustration of a burner or lance wherein the flow direction of the fluid is changed by the use of the invention.

FIG. 3A is a head on view of one embodiment of the apparatus of this invention.

FIG. 3B is a cross sectional view of the apparatus illustrated in FIG. 3A.

FIG. 4A is a head on view of another embodiment of the apparatus of this invention.

FIG. 4B is a cross sectional view of the apparatus illustrated in FIG. 4A.

DETAILED DESCRIPTION

Figure 5A:
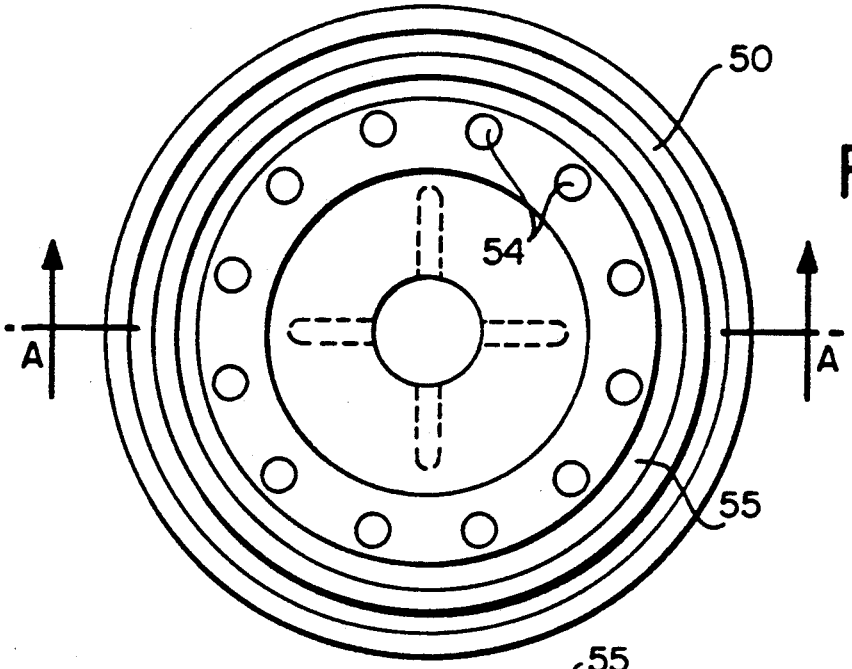
FIG. 5A is a head on view of a burner nozzle incorporating one embodiment of the apparatus of this invention.

This invention will be described in detail with reference to the drawings. A burner is an apparatus through which both fuel and oxidant are provided into a combustion zone and a lance is an apparatus through which only one of fuel or oxidant is provided into a combustion zone. The invention will find particular utility when used with high velocity oxygen burners or lances. Two recent significant advances in the field of high velocity oxygen burners are described and claimed in U.S. Pat. No. 4,541,796—Anderson and U.S. Pat. No. 4,907,961—Anderson.

Referring now to FIG. 1, burner 1 is installed within furnace wall 2 and serves to provide fuel and oxidant into combustion zone 3. Fuel 11 is provided to and through burner 1 by passage means 4 and oxidant 12 is provided to and through burner 1 by passage means 5. The fuel may be any combustible fluid. The oxidant may have any concentration of oxygen from that of air to that of technically pure oxygen having an oxygen concentration of 99.5 percent or more. The invention will have particular utility with an oxidant having an oxygen concentration of at least 30 percent.

Biasing fluid 6 is provided into and through burner 1 through supply lines 7 and 8 and is passed into fluidic burner nozzle 9 which will be described in detail later. Biasing fluid is supplied into either supply line 7 or supply line 8, or is shut off completely, by operation of switching valve 10. The biasing fluid 6 is preferably the same fluid as the biased fluid which in the case of a burner would be either the fuel or the main oxidant. In the example illustrated in FIG. 1 the biased fluid is the oxidant 12 supplied to burner 1 through passage means 5.

Referring to FIGS. 2A, 2B and 2C wherein the numerals are the same for the common elements, burner or lance 20 has passing through it a fluid which is injected into combustion zone 21 through nozzle 22. Biasing fluid may be supplied through burner or lance 20 to nozzle 22 through either supply line 23 or supply line 24. In FIG. 2A there is illustrated the case where there is no biasing fluid being supplied to nozzle 22. In this case fluid 25 is injected into combustion zone 21 without a change to its flow direction, i.e. axially aligned with burner or lance 20. In FIG. 2B there is illustrated the case where biasing fluid 26 is provided to nozzle 22 by way of supply line 24. In this case the direction of fluid 25 as it is provided into combustion zone 21 is changed to that illustrated in FIG. 2B by the action of biasing fluid 26 within nozzle 22. In FIG. 2C there is illustrated the case where biasing fluid 27 is provided to nozzle 22 by way of supply line 23. In this case the direction of working fluid 25 as it is provided into combustion zone 21 is changed to that illustrated in FIG. 2C by the action of biasing fluid 27 within nozzle 22.

The remaining Figures illustrate in greater detail the method and apparatus of the invention.

In FIGS. 3A and 3B the numerals are the same for the common elements. Referring now to FIGS. 3A and 3B, nozzle 30 comprises a fluidic cavity having an inlet 36 and an outlet 34. The fluidic cavity comprises expanded flow area 31 having a conical surface, defining an outwardly expanding flow area, which communicates with outlet 34, and restricted flow area 38 which communicates with inlet 36. Outlet 34 communicates with combustion zone 35 and inlet 36 communicates with fluid provision means 37 which provides fluid, e.g. oxidant, into the fluidic cavity. The restricted flow area has a diameter D at the point where it communicates with the expanded flow area. Generally, D will be within the range of from 0.125 to 1.5 inches and typically D will be within the range of from 0.125 to 1.0 inch; however the diameter D will depend upon the firing rate. The fluid is provided into the fluidic cavity from the fluid provision means and is passed through the restricted flow area at a high velocity, generally at a velocity of at least 500 feet per second and preferably at sonic velocity or greater up to about 1700 feet per second or more depending upon the sonic velocity of the fluid being used. At velocities greater than sonic, the velocity is the apparent jet velocity which is defined as the volumetric flow rate, at ambient pressure, leaving an orifice divided by the cross sectional area of the orifice. The high velocity fluid is provided into and through the fluidic cavity into a reduced pressure zone adjacent to the surface of restricted area 38.

Biasing fluid is provided into the fluidic cavity through one or more biasing fluid provision means. FIGS. 3A and 3B illustrate an embodiment having two biasing fluid provisions means labelled 60 and 61. Typically the invention will employ at least two biasing fluid provision means or injection points and usually the number will be within the range of from 2 to 8. The biasing fluid provision means are oriented so as to supply biasing fluid into the fluidic cavity at a reduced pressure zone and in a direction substantially perpendicular to the flow direction of the fluid passing through the restricted flow area, i.e., substantially perpendicular to fluidic cavity axial centerline 39.

The biasing fluid provision means has a diameter d where it communicates with the fluidics cavity such that the ratio d/D is within the range of from 0.18 to 0.75, preferably from 0.18 to 0.25. Typically d will be within the range of from 0.10 to 0.15 inch. It is recognized that in some situations it may be preferable that the shape of the cross section of the biasing fluid provision means or the point of communication between the restricted and expanded flow areas be other than circular. For example, the cross-sectional shape may be elliptical or that of a rectangular slot. In such a case the diameter D and/or d is the smaller of the widths defining the opening.

The biasing fluid provision means communicates with the fluidic cavity such that its center is at a point within the range of from $3d/4$ upstream to d/4 downstream of the point of communication between the restricted flow area and the expanded flow area. Preferably this range is within the range of from d/2 upstream of the point of communication to the point of communication between the restricted flow area and the expanded flow area. Most preferably the biasing fluid provision means communicates with the fluidic cavity at a point about d/2 upstream of this point of communication. In the embodiment illustrated in FIGS. 3A and 3B the biasing fluid provision means 60 and 61 communicate with the fluidic cavity at the point d/2 upstream of the point where the restricted flow area communicates with the expanded flow area.

In operation, fluid is provided into fluidic cavity restricted flow area 38 through the fluid provision means 37. When no biasing fluid is provided, the fluid proceeds through the fluidic cavity and into combustion zone 35 with no change in direction. However, when biasing fluid is provided into the fluidic cavity at the reduced pressure zone through, for example, biasing fluid provision means 60, the working fluid is caused to change flow direction and passes into combustion zone 35 in a direction such as that indicated by arrow 62. This biasing fluid flow causes a deflection of the fluid flow and causes the free fluid jet to attach itself to the fluidic cavity wall opposite from where the biasing fluid is directed into the fluid. This change in direction is due to a pressure difference caused by the asymmetrical aspiration of fluid into the fluid flow jet because of its proximity to the wall. A free jet, when unobstructed, will entrain the surrounding gas uniformly and expand symmetrically about its axis. However, when placed adjacent to a wall, the entrainment of surrounding gas is limited by the presence of the wall. This creates a low pressure region between the jet and the wall serving to push the fluid flow to conform with the direction of the wall. Generally the pressure difference across the fluid jet will be about 1 pound per square inch (psi) or more for an effective direction change.

The flow of fluid may be switched to another direction by changing the biasing fluid flow. For example, biasing fluid provided through means 60 may be stopped and biasing fluid may be provided through means 61. This will cause the fluid to pass into combustion zone 35 in a direction such as that indicated by arrow 63. When the proper amount of biasing fluid is supplied, it acts to break the vacuum between the main fluid jet and the wall it is attached to and hence eliminates the pressure difference created by the wall. Continued flowing of the biasing gas will cause a slight pressure rise on that side of the jet and cause it to be deflected toward the opposite wall and attach itself there in the manner previously described.

In this way the flow direction of fluid flowing into a combustion zone may be changed without need for adjusting the burner or lance or changing the nozzle. The flow direction may be changed between as many positions as there are biasing fluid provision means. In a burner or a lance, the high velocity fluid, such as oxidant, upon exiting the fluidic cavity, such as in a direction indicated by arrows 62 or 63, will effectively entrain fuel provided into the combustion zone through the burner or otherwise available in the combustion zone. Thus the fuel and oxidant will flow in the same direction despite the redirection of the oxidant, and their intermixture during the entrainment will enable stabilized combustion to occur. The combustion will be initiated either by an appropriate ignition device or by ongoing combustion within the combustion zone.

The use of fluidics to change the flow direction of a fluid is known but has not heretofore been effectively employed to change the flow direction of high velocity fluid of a burner or lance. Without desiring to be held to any theory, applicants believe that the successful direction change of high velocity fluid is due to the injection of biasing fluid into the main fluid flow further upstream than in conventional fluidics practice. In conventional fluidics practice, biasing fluid is passed into the main flow considerably downstream of the point where the fluidics cavity begins to expand. In the practice of this invention, biasing fluid is injected into the main fluid flow at or upstream of the communication point between the restricted flow area and the expanded flow area, or only a small distance downstream of this point. Applicants believe that with a high velocity main fluid flow, the radial distance between the jet and the cavity wall becomes too great very shortly past the point where the cavity begins to expand to enable biasing fluid to cause a directional change without encountering instability or without expending a large amount of fluid as the biasing fluid.

Generally and preferably both the main fluid and the biasing fluid are gaseous. Generally the biasing fluid will be provided into the fluidic cavity with a flowrate of from 0.5 to 3.0 percent of that of the main fluid. The velocity of the main fluid may be quite high while still achieving effective switching. Effective switching has been achieved with oxygen as a main fluid with an apparent velocity as high as 1700 feet per second (fps) through the restricted flow area.

In order to achieve effective directional change, the length of the expanded flow area of the fluidic cavity from the point of communication with the restricted flow area to the outlet must be sufficient to achieve the requisite pressure differential. While the minimum effective length will vary depending on velocity and configuration factors, it has been found that an expanded flow area fluidic cavity length of at least 3D is sufficient to generate the requisite pressure differential and preferably this length is within the range of from 2.5 D to 9 D. This length is defined as length L in FIG. 3B.

The invention will have increased effectiveness when the angle made by the expanded flow area wall of the fluidic cavity with the axial centerline of the fluidic cavity is within the range of from 10 to 30 degrees. When the expanded flow area wall comprises surfaces which make more than one angle with the axial centerline, the relevant angle referred to above is the initial angle.

In FIGS. 4A and 4B the numerals are the same for the common elements. Referring now to FIGS. 4A and 4B, nozzle 40 comprises a fluidic cavity having an inlet 46 and an outlet 44. The fluidic cavity comprises expanded flow area 41 having a curved surface which communicates with outlet 44, and a restricted flow area 48 which communicates with inlet 46. Outlet 44 communicates with combustion zone 45 and inlet 46 communicates with fluid provision means 47 which provides main fluid into the fluidic cavity for flow through the restricted flow area at a high velocity. Restricted flow area 48 communicates with expanded flow area 41 at the point downstream of restricted flow area 48 where expanded flow area 41 begins to expand. The high velocity fluid creates a low or reduced pressure zone near the walls by the inertial effect as it enters expanded flow area 41 from restricted flow area 48. Biasing fluid is provided into the fluidic cavity through either of biasing fluid provision means 70 or 71. As can be seen, in the embodiment illustrated in FIGS. 4A and 4B the biasing fluid is provided into the fluidic cavity at the transition from the restricted flow area to the expanded flow area, whereas in the embodiment illustrated in FIGS. 3A and 3B the biasing fluid is provided into the fluidic cavity upstream of this transition point. When the expanded flow area has a curved surface, such as is illustrated in FIGS. 4A and 4B, the biasing fluid provision means communicates with the fluidic cavity at a point where the expanded flow area surface forms an angle with the fluidic cavity centerline of 5 degrees.

The invention comprises the provision of biasing fluid substantially perpendicular to the axial centerline of a fluidic cavity into a reduced pressure zone generally at or upstream of the transition point to effectively change the flow direction of high velocity fluid passing through a fluidic cavity. The restricted flow area helps to achieve the high velocity of the fluid which in turn causes the generation of the reduced pressure zone. Generally the biasing fluid will be provided into the fluidic cavity at or upstream of the transition point where the restricted flow area communicates with the expanded flow area. This provision point, as opposed to a more downstream point, enables more efficient flow direction change of a high velocity stream without encountering instability.

Figure 5B:
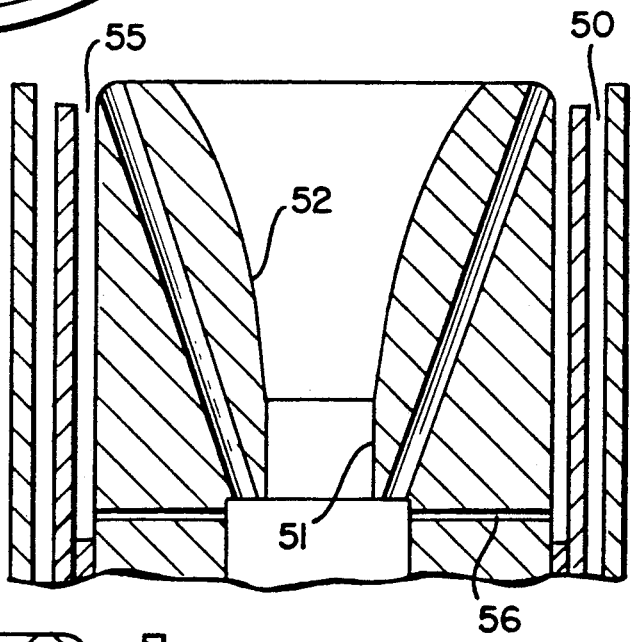
FIG. 5B is a cross sectional view of the burner nozzle illustrated in FIG. 5A.
Figure 5C:
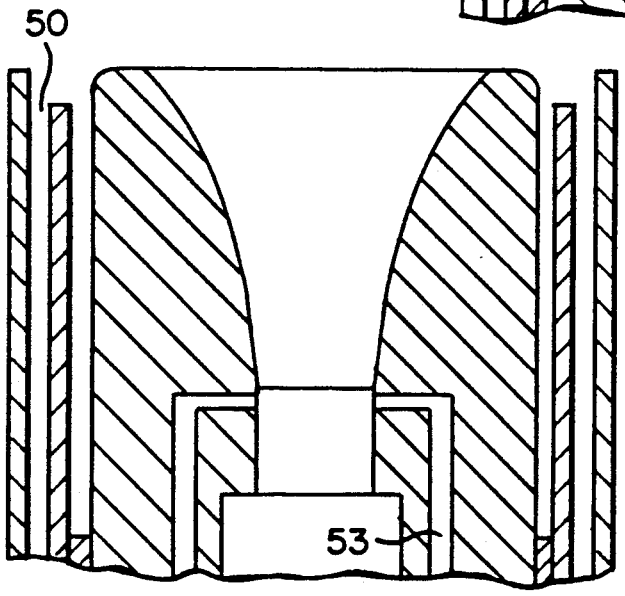
FIG. 5C is a sectional view taken along line A—A of the burner nozzle illustrated in FIG. 5A.

FIGS. 5A, 5B and 5C illustrate another embodiment of the invention wherein the invention is employed in a particular oxygen burner. The numerals in FIGS. 5A, 5B and 5C are the same for the common elements.

The fuel for the burner is provided through a concentric passage 50 around the outside of the nozzle illustrated in FIGS. 5A, 5B, and 5C. Referring to FIG. 5B, the oxygen which is supplied from the central passage of the nozzle is split into three parts, the main jet, the multiple small jets, and the annulus oxygen.

The main jet contains from about 50 to 95 percent and generally about 60 percent of the requisite oxygen flow and passes through the restriction 51 and into the expanded flow area 52 of the fluidic cavity. The direction of this jet is controlled by flowing biasing oxygen through any one of the biasing flow passages 53 illustrated in FIG. 5C. When biasing oxygen, from a separate source, is supplied through a biasing passage, the main oxygen jet attaches itself to the tapered cavity at about a 10° angle opposite the biasing flow passage, and following the wall of the cavity, exits the nozzle at about a 40° angle from the nozzle axis. The combination of the conical and curved cavity enables large angles of deflection for short nozzle lengths. Using this technique the deflection of the main jet up to an angle of 90 degrees from the nozzle axis has been achieved.

The multiple oxygen jets 54 contain from about 20 to 50 percent and generally contain about 37 percent of the requisite oxygen flow and provide quick and complete entrainment of the fuel surrounding the fluidic nozzle. This ensures that all the fuel supplied to the burner is burned. Because the main oxygen jet controlled by fluidics has a much higher momentum than the multiple jets, it determines the direction of the bulk flow of gases. Hence the multiple jets bend and follow the direction of the main jet as it is switched via fluidics.

The remaining 2 to 8 percent, generally 3 percent, of the requisite oxygen flows through passage 56 into an annular space 55 around the nozzle and exits at the end of the nozzle. This small oxygen flow acts to stabilize the high velocity oxygen jets in the manner as described in U.S. Pat. No. 4,907,961—Anderson.

The following Example is provided for illustrative purposes and is not intended to be limiting.

EXAMPLE

The fluidic nozzle shown in FIGS. 5A, 5B and 5C was mounted in an oxygen/fuel burner and operated at a firing rate of 10 million Btu/hr. Technically pure oxygen was used as the oxidant and was supplied at a rate of 20,000 standard cubic feet per hour (scfh). This resulted in an apparent velocity of 1700 ft/sec for the fluid passing through the fluidic cavity restriction. Natural gas was supplied through the pipe surrounding the nozzle at a flow rate of 10,000 scfh.

Biasing fluid was supplied at a rate of 100 scfh through one of four different biasing flow passages. With no biasing flow, the flame remained in an axial position. Once the biasing flow was turned on to a biasing passage, the flame deflected to a location about 40° from the axis of the burner opposite the passage supplying the biasing flow. By redirecting the biasing flow to another passage, the flame would move to a new quadrant depending on which passage the biasing fluid was supplied through. The passage through which the biasing flow was supplied was controlled external to the burner through a series of valves. Stable combustion was maintained throughout all the flow direction changes.

The invention has been described in detail with reference to certain embodiments employed in conjunction with a burner or a lance. Those skilled in the art will recognize that there are other embodiments of the invention within the scope and spirit of the claims.

We claim:

1. Apparatus for changing the flow direction of a high velocity fluid stream injected into a combustion zone comprising:

(A) a fluidic cavity having a restricted flow area communicating downstream thereof with an expanded flow area, said restricted flow area having a diameter D at said point of communication sufficient to enable fluid passing therethrough to have a supersonic velocity, said expanded flow area having a length of from 3 D to 9 D, so as to establish a reduced pressure zone adjacent a portion of the surface of the fluidic cavity; and (B) means for providing biasing fluid into the fluidic cavity in a direction substantially perpendicular to the axial centerline of the fluidic cavity, said means having a diameter d such that d/D is within the range of from 0.18 to 0.75, said biasing fluid provision means communicating with the fluidic cavity at a point within the range of from $3d/4$ upstream to d/4 downstream of the point of communication between the restricted flow area and the expanded flow area, where D and d are measured in the same units.

2. The apparatus of claim 1 wherein the expanded flow area of the fluidic cavity has an inner surface which has a conical shape.

3. The apparatus of claim 1 wherein the expanded flow area of the fluidic cavity has an inner surface which is curved.

4. The apparatus of claim 1 wherein the biasing fluid provision means provides biasing fluid into the fluidic cavity at or upstream of the point of communication between the restricted flow area and the expanded flow area.

5. The apparatus of claim 1 wherein the biasing fluid provision means comprises a plurality of injection points.

6. The apparatus of claim 5 wherein the number of injection points is within the range of from 2 to 8.

7. The apparatus of claim 1 employed within a burner.

8. The apparatus of claim 1 employed within a lance.

9. The apparatus of claim 1 wherein d/D is within the range of from 0.18 to 0.25.

10. The apparatus of claim 1 wherein the surface of the expanded flow area forms an angle with the axial centerline of the fluidics cavity which is within the range of from 10 to 30 degrees.

11. Method for changing the flow direction of a high velocity main fluid stream injected into a combustion zone comprising:

(A) providing a flow of main fluid through a fluidic cavity having a restricted flow area of diameter D communicating downstream thereof with an expanded flow area wherein the main fluid flows through the restricted flow area at a supersonic velocity and through the expanded flow area for a length of from 3 D to 9 D to establish a reduced pressure zone adjacent a portion of the surface of the fluidic cavity;

(B) injecting a biasing fluid stream having a diameter d into the fluidic cavity at the reduced pressure zone in a direction substantially perpendicular to the flow direction of the main fluid passing through the restricted flow area at a point within the range of from 3d/4 upstream to d/4 downstream of the point of communication between the restricted flow area and the expanded flow area, where D and d are measured in the same units; and (C) changing the flow direction of the main fluid.

12. The method of claim 11 wherein the main fluid is an oxidant.

13. The method of claim 11 wherein the main fluid and the biasing fluid are the same species.

14. The method of claim 11 wherein both the main fluid and the biasing fluid are gaseous.

15. The method of claim 11 wherein the flow rate of the biasing fluid is within the range of from 0.5 to 3.0 percent of the flowrate of the main fluid.

16. The method of claim 11 wherein the biasing fluid is injected into the fluidic cavity at or upstream of the point of communication between the restricted flow area and the expanded flow area.

17. The method of claim 14 further comprising entraining fuel into the oxidant within the combustion zone and combusting the resulting mixture of fuel and oxidant.

* * * * *